US005616452A

United States Patent [19]

Gogle et al.

[11] Patent Number: 5,616,452

[45] Date of Patent: Apr. 1, 1997

[54] PHOTOGRAPHIC PROCESSOR AND METHOD FOR REPLENISHING

[75] Inventors: Ronald A. Gogle, Rochester; William S. Lane, Honeoye Falls, both of N.Y.

[73] Assignee: Eastman Kodak Company, Rochester, N.Y.

[21] Appl. No.: 413,321

[22] Filed: Mar. 30, 1995

[51] Int. Cl.[6] ..... G03C 5/395; G03C 7/44

[52] U.S. Cl. ..... 430/398; 430/399; 430/400

[58] Field of Search ..... 430/265, 357, 430/359, 398, 399, 400, 401

[56] References Cited

U.S. PATENT DOCUMENTS

| | | | |
|---|---|---|---|
| 4,228,234 | 10/1980 | Okutsu et al. | 430/399 |
| 4,314,753 | 2/1982 | Kaufmann | 354/321 |
| 4,332,456 | 6/1982 | Kaufmann | 354/248 |
| 4,341,453 | 7/1982 | Rubin | 354/298 |
| 4,642,276 | 2/1987 | Burtin | 430/399 |
| 5,063,141 | 11/1991 | Nakamura | 430/399 |
| 5,180,648 | 1/1993 | Nakamura | 430/21 |
| 5,235,369 | 8/1993 | Nakamura et al. | 354/298 |
| 5,252,439 | 10/1993 | Nakamura . | |
| 5,315,337 | 5/1994 | Skye | 354/298 |
| 5,460,926 | 10/1995 | Komatsu et al. | 430/401 |

*Primary Examiner*—Hoa Van Le
*Attorney, Agent, or Firm*—Frank Pincelli

[57] ABSTRACT

A method and apparatus for processing a photosensitive material. The apparatus having at least one processing tank containing a processing solution for processing the photosensitive material, a replenishment system for replenishing the processing solution comprising a first part and a second part, the first and second parts each having independent usage rates, means for measuring the distribution of transmittance of the photosensitive material being processed by the at least one processing tank, and means for independently supplying the first and second parts to the at least one processing tank in accordance with the distribution of the transmittance of the photosensitive material being processed, the ratio of the volume of the first part to the volume of the second part to be delivered to the tank being at least 10 to 1.

3 Claims, 1 Drawing Sheet

PHOTOGRAPHIC PROCESSOR AND METHOD FOR REPLENISHING

FIELD OF THE INVENTION

The present invention relates to the field of silver halide photographic processors. More particularly, to a method and apparatus for improving the process stability by monitoring a predetermined parameter and automatically providing the correct concentration and amount of replenisher to the processing solution.

BACKGROUND OF THE INVENTION

Typical prior art photographic film processors comprise a plurality of processing tanks, each containing a processing solution for effecting treatment to a photosensitive film which passes through the processing tank. Each of the processing tanks require replenishment solution to be added in order to restore the chemical components of the processing solution and dilute the by-products of the development reaction that occurs within the tank. The addition of the replenishment solution maintains the tank activity at a substantially constant level. The chemical formula of a replenisher is based on the chemical consumption and/or generation that occurs when processing an average film with average exposure, or an average distribution of film types and speed with an average distribution of exposures. The amount of the replenisher is based on the area of the film that has been exposed. In practice, the concentration and rates are often determined for an individual processor by trial and error and through experience.

There are several problems associated with prior art replenishment systems. One problem is that the chemical composition of the replenisher may not be adequate for all film types and mixtures of films. This results in non-standard chemical levels or activity when processing other than the standard film or film mix. Another problem experienced by prior art processors is that the chemical composition of the replenisher may not be adequate for all types or distributions of exposures. The generation or consumption of chemicals from the film will vary depending upon the amount of exposure the film has received. A further problem associated with the replenisher is that the quantity of replenisher is not optimized for all film types and exposures. In addition to supplying of chemical components that are consumed in development, the replenisher is used to flush or dilute the by-products coming from the film. Different film speeds or types can have different generation or consumption terms. Different exposure levels will also change the chemical generation. The is particularly true of standard development by-products such as iodide (measured as KI) and bromide (measured as NaBr) in the developers. Current replenishment systems can not compensate for practical processing occurrences such as portions of film that are either unexposed or totally fogged. The chemical generation for such films will be sufficiently different than that of correctly exposed film. Also, current replenishment system rates are typically based on the surface area of Film that has been processed. A predetermined amount of replenisher is used for a set amount of film. The concentration of the individual components in the replenisher are set by the manufacturer of the replenisher. The end user has only limited flexibility in modifying its use. Replenishers that are supplied in more than one part are required to be used in a set ratio.

There has been suggested in the prior art the introduction of replenishment solution to the processing tank based upon the final density of the film that has been processed. The density is measured and a predetermined amount of replenishment solution is supplied to the processing tank. However, these systems, have a single replenisher containing multiple chemical components. The components are simply provided in one predetermined ratio. Therefore, at least one of the components will be added at a rate different than what is necessary for the optimum replenishment of the processing solution.

Applicants have invented an improved method and apparatus for processing the photosensitive material which utilizes a multiple component replenishment system wherein means are provided for measuring a known parameter of the photosensitive material during processing, and based on this information, means for independently supplying the individual components of the multiple chemical components necessary for replenishing the processing solution.

SUMMARY OF THE INVENTION

In one aspect of the invention there is provided an apparatus for processing a photosensitive material. The apparatus comprising:

- at least one processing tank containing a processing solution for processing the photosensitive material;
- a replenishment system for replenishing the processing solution comprising a first part and a second part, the first and second parts each having independent usage rates;
- means for measuring the distribution of transmittance of the photosensitive material being processed by the at least one processing tank; and
- means for independently supplying the first and second parts to the at least one processing tank in accordance with the distribution of the transmittance of the photosensitive material being processed, the ratio of the volume of the first part to the volume of the second part to be delivered to the tank being at least 10 to 1.

In another aspect of the present invention there is provided a method of replenishing a processing solution in a processor for processing photosensitive material the processor having at least one processing tank containing a process solution for processing the photosensitive material and a two part replenishment system for replenishing the processing solution, the two part processing replenishment system comprising a first part and a second part, the ratio of the volume of the first part to the volume of the second part to be added to the tank being equal to or greater than 10 to 1, the first and second parts each having independent usage and/or generation rates, comprising the steps of:

- measuring the distribution of transmittance of the photosensitive material being processed through the processor; and
- supplying the first and second parts independently in accordance with the distribution of transmittance being measured.

DESCRIPTION OF THE DRAWING

Referring to the FIGURE, there is illustrated a portion of a processor made in accordance with the present invention.

DETAILED DESCRIPTION

Figure 1:
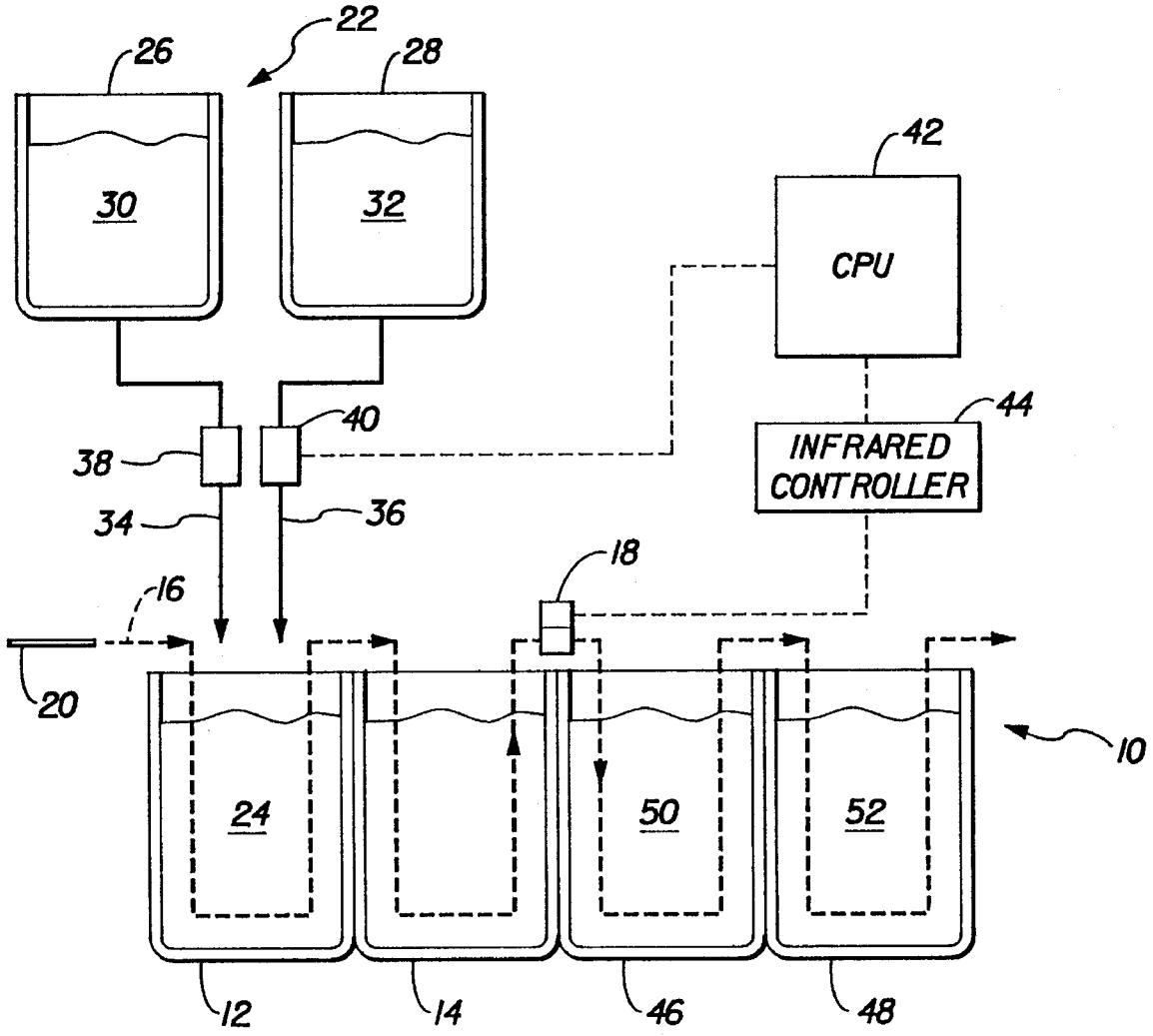

Referring to the drawing, there is illustrated a portion of a processor 10 made in accordance with the present invention. The processor 10 includes a developer tank 12 designed to hold a developer processing solution and an adjacent wash tank 14 designed to hold water or some other processing solution. An infrared monitor 18 is provided for measuring the transmittance of the appropriate wavelength(s) of electromagnetic radiant energy of a photosensitive material that has passed through the developer tank 12 and wash tank 14 along film path 16. The density of the photosensitive material can be directly determined from the transmittance. In the particular embodiment illustrated, the photosensitive material comprises film. A replenishment system 22 is provided for replenishing the processing solution 24 placed in developer tank 12. The replenishment system 22 includes a pair of reservoir tanks 26,28 designed to hold a primary replenishing solution 30 and a secondary replenishing solution 32. Fluid communication means 34,36 provides fluid communication between the reservoir tanks 26,28 with the developer tank 12 such that replenishment solutions 30,32 are supplied to the developer tank. Replenishment controllers 38,40 are provided in fluid communication means 34,36 for controlling the rate at which the replenishment solutions are delivered to the developer tank 12. In the particular embodiment illustrated, controllers 38,40 each comprise a metering pump, for example, possible displacement bellows pump. A computer 42 (CPU) is used to control the replenisher controllers 38,40. The CPU 42 receives data from the infrared controller 44, which receives a signal from the infrared monitor 18. However, if desired, the formation of controller 44 may be incorporated into CPU 42. This information is used by the CPU 42 to adjust the flow rates of the replenishment solutions 30,32 to the developer tank 12.

The progress of the photosensitive material along path 16 is monitored and tracked as it is transported through the processor 10. This can be done through simple timing, or preferably, through bar coded, twin checks that can be monitored in line. This allows the CPU 42 to know when film is passing through infrared monitor 18 and can direct the infrared monitor to begin and/or stop the measurement process.

The infrared monitor 18 measures the infrared density of the film after film leaves the developer, but before it enters the subsequent processing tanks 46,48, each contains a chemical processing solution 50,52, respectively. The additional processing solution may be a fix, bleach, or any other processing solution required. Preferably, the density of the film 20 is measured after a water rinse to avoid any interference from the developer chemistry. The infrared monitor 18 is used to measure the extent of development that has occurred on the photosensitive material 20. It is to be understood that other methods and parameters may be used to determine the development extent the photosensitive material has undergone through the developer tank. Infrared monitor 18 is preferable because it provides a direct measurement of the silver developed and provides the information immediately.

The infrared density relates to the amount of silver halide that has been developed to metallic silver. An algorithm or look-up table that relates the measured infrared density to chemical generation is pre-programmed in the CPU 42. An algorithm can be empirically determined which relates chemical generation (in terms of amount per area of film) to the infrared density for each film type. Each film can have its own look-up table, or similar films can use the same table.

As previously noted, the replenishment system may be divided to a multiple number of replenishment solutions, i.e., two or more parts. In the particular embodiment illustrated, there is a primary replenishment solution 30 and a secondary replenishment solution 32. The primary replenishment solution contains a majority of the chemical solution, whereas the secondary replenishment solution 32 contains individual components (such as KI) which will need to be supplied independently in varying amounts with respect to the first part depending on the film type or exposure detected. The secondary replenishment solution will be used at a significantly lower rate than the primary replenishment solution 30. Preferably, the secondary replenishment solution is usually less than 10% of the primary solution so that the primary replenishment solution will not be significantly diluted when the secondary replenishment solution is added. Accordingly, the ratio of the primary processing solution to the secondary solution is greater or equal to 10:1.

The average infrared density, or preferably, a distribution of density is measured by the infrared monitor 18 and sent to the infrared controller 44. The controller uses the film type information previously obtained (for example, as read by the scanner at the splice station) to choose the appropriate algorithms or look-up table to determine the amount of chemistry consumed or generated by the film.

The chemical generation or consumption, along with the quantity of film, will determine the amount of each replenishing solution that is to be used. In the particular embodiment illustrated, the primary replenishment solution is used to flush out excessive halide build-up and/or to maintain the level of developer components. The secondary replenishment solution 32 is used to inject the correct amount of critical chemicals, such as KI.

In order to utilize the present invention, certain characteristics of the film to be processed must first be determined by empirical method. For example, if the processor is designed to process Kodachrome film in 35mm film format (Kodachrome is a trademark of Eastman Kodak Company) known exposures would be provided on the film wherein the film would then be passed through a processor. After the film has been processed, density measurements would be obtained for each various exposure. The amount of chemistry used or generated for this processing would then be measured. This information can then be translated into the amount of chemistry that has been used in each of the processing solutions, for example, in the developer, fix, and bleach tanks, which can then be translated into the amount of replenishment that is necessary in film of that type exposure that has been processed. Thus, this information can be put in the form of a table in the storage portion of a computer which then can be used to determine the specific amount of replenishment needed to compensate for development of a film that has been passed through the processor. This type process is repeated for each of the type films the processor will process. The drawing illustrates a typical application of the present invention with respect to the replenishment, in particular, the replenishment system for the development processing solution. Mass balance for the replenishment system:

$$Cp \times Rp + Cs \times Rs + G = Ct \times (Rp + Rs - Rx) \quad (1)$$

wherein:

Cp =Concentration in primary replenisher part

Cs =Concentration in secondary replenisher part

Ct =concentration in tank

Rp =Replenisher rate of primary replenisher part

Rs =Replenisher rate of secondary replenisher part

G =Generation

Rx =Rate of carry-over

Assuming that Cs is zero, and Rs and Rx are significantly less than Rp (and also based on the fact that Rs and Rx are of the same order of magnitude and will tend to offset each other), calculation of the rate Rp that will be necessary to maintain a constant level of NaBr is closely approximated by the equation:

$$Cp \times Rp + G = Ct \times Rp \quad (2)$$

Solving for Rp yields:

$$Rp = \frac{G}{(Ct - Cp)} \quad (3)$$

For the NaBr in Process K-14:

Ct=3.70 g/L

Cp=1.23 g/L

G=function of infrared density

G is a variable that is known as a function of infrared density that has been empirically determined. Therefore, the rate for the primary part (Rp) can be calculated for any given infrared density by using equation (3).

The rate of the secondary part (Rs) to maintain a constant level of KI in the tank can be calculated by equation (1). There is no KI in the primary part (Cp=0), so equation (1) becomes:

$$Cs \times Rs + G = Ct \times (Rp + Rs - Ri) \quad (4)$$

Solving for Rs, and using the assumption that Ri is significantly less than Rp, yields:

$$Rs = \frac{Ct \times Rp - G}{Cs - Ct} \quad (5)$$

For KI in Process K-14:

Cs=1.0 g/L

Ct=20.0 mg/L

Rp=function of density and calculated by equation (3)

G=Function of density

G is a variable that is known as a function of infrared density. Therefore, the rate of the secondary part (Rs) can be calculated for any given infrared density by using equation (5).

Thus, it can be seen that the primary and secondary replenishment rates can be determined based on the infrared density measuring and the values previously stored in the look-up table. Accordingly, the processor control unit would then activate the appropriate controls for delivering of the first and second replenishment solutions 30,32 in the amounts required.

In the preferred form of the present invention, infrared density is measured of the processed photosensitive material. However, any other predetermined parameter which can be related to the amount of replenishment necessary may be provided. Using an infrared sensor is advantageous in that the density can be quickly and easily measured and passed on to the computer for appropriate manipulation in controlling of the replenishment solution. While the present invention has been described for use in replenishing developer solution having at least two components, the present invention can be used for other processing solutions having two or more components.

It is to be understood that various other changes and modifications may be made without departing from the scope of the present invention, the present invention being limited by the following claims.

Parts List

10...processor
12...developer tank
14... wash tank
16...film path
18...infrared monitor
20...photosensitive material
22...replenishment system
24...processing solution
26,28...reservoir tanks
30...primary replenishing solution
32...secondary replenishing solution
34,36...fluid communication means
38,40...replenishment controllers
42...computer (CPU)
44...infrared controller
46,48...processing tanks
50,52...chemical processing solution

We claim:

1. A method of replenishing a processing solution in a processor for processing photosensitive material, said processor having at least one processing tank containing a process solution for processing said photosensitive material and a two part replenishment system for replenishing the processing solution, said two part processing replenishment system comprising a first part and a second part, the ratio of the volume of said first part to the volume of said second part to be added to the tank being equal to or greater than 10 to 1, said first and second parts each having independent usage rates, comprising the steps of:

measuring a parameter of said photosensitive material being processed by said at least one processing tank, said parameter being representative of the extend of usage of said first and second parts of said processing solution; and supplying said first and second parts independently in accordance with said parameter.

2. A method of replenishing a processing solution in a photo processor for processing photosensitive material, said processor having a first processing tank and at least one other processing tank, each processing tank containing a process solution for processing said photosensitive material and a two part replenishment system for replenishing the processing solution, said two part processing replenishment system comprising a first part and a second part, the ratio of the volume of said first part to the volume of said second part to be added to the tank being equal to or greater than 10 to 1, said first and second parts each having independent usage rates, comprising the steps of:

measuring the distribution of infrared density of said photosensitive material after passing through said first processing tank and before passing through the last of said at least one other processing tank; and supplying said first and second parts independently in accordance with the distribution of infrared density being measured.

3. A method of replenishing a processing solution in a photo processor for processing photosensitive material, said processor having at least one processing tank containing a process solution for processing said photosensitive material and a two part replenishment system for replenishing the processing solution, said two part processing replenishment system comprising a first part and a second part, the ratio of the volume of said first part to the volume of said second part to be added to the tank being equal to or greater than 10 to 1, said first and second parts each having independent usage rates, comprising the steps of:

measuring the distribution of transmittance of said photosensitive material being processed through said processor; and supplying said first and second parts independently in accordance with the distribution of optical density being measured.

* * * * *